US008616166B2

(12) United States Patent
Yang et al.

(10) Patent No.: US 8,616,166 B2
(45) Date of Patent: Dec. 31, 2013

(54) ELECTRIC CONTINUOUS VARIABLE VALVE TIMING APPARATUS

(75) Inventors: Jei Choon Yang, Yongin-si (KR); Byong Young Choi, Bucheon-si (KR); Jin Kook Kong, Suwon-si (KR); Soo Hyung Woo, Yongin-si (KR); Young Jin Won, Hwaseong-si (KR); Jin Soon Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 50 days.

(21) Appl. No.: 13/302,934

(22) Filed: Nov. 22, 2011

(65) Prior Publication Data

US 2012/0298059 A1 Nov. 29, 2012

(30) Foreign Application Priority Data

May 23, 2011 (KR) ..... 10-2011-0048728

(51) Int. Cl.
*F01L 1/34* (2006.01)

(52) U.S. Cl.
USPC ..... 123/90.17; 123/90.18

(58) Field of Classification Search
USPC ..... 123/90.15, 90.17, 90.18, 90.31; 464/1, 464/2, 160, 161; 74/568 R
See application file for complete search history.

(56) References Cited

U.S. PATENT DOCUMENTS

| | | | | |
|---|---|---|---|---|
| 5,673,659 | A * | 10/1997 | Regueiro | 123/90.17 |
| 6,167,854 | B1 * | 1/2001 | Regueiro | 123/90.17 |
| 6,729,280 | B2 * | 5/2004 | Muraki | 123/90.15 |
| 2012/0111292 | A1 * | 5/2012 | Yang et al. | 123/90.15 |

FOREIGN PATENT DOCUMENTS

| | | | |
|---|---|---|---|
| JP | 2010065677 | A | 3/2010 |
| JP | 2010151143 | A | 7/2010 |
| KR | 1020020015825 | A | 3/2002 |

* cited by examiner

*Primary Examiner* — Thomas Denion
*Assistant Examiner* — Ngoc T Nguyen
(74) *Attorney, Agent, or Firm* — Morgan, Lewis & Bockius LLP

(57) ABSTRACT

An electric continuously variable valve timing apparatus may include a cam sprocket, a camshaft rotatably connected with the cam sprocket, a motor portion, a lead screw portion which may be disposed within the motor portion, may be screwed-engaged with the motor portion, and moves along length direction of the camshaft according to operations of the motor portion, and a camshaft holder rotatably connecting the lead screw portion and the cam sprocket, wherein the camshaft holder moves along length direction of the camshaft according to the movement of the lead screw portion and varies relative phase angle between the cam sprocket and the camshaft for controlling valve timing.

10 Claims, 7 Drawing Sheets

ELECTRIC CONTINUOUS VARIABLE VALVE TIMING APPARATUS

CROSS-REFERENCE TO RELATED APPLICATION

The present application claims priority to Korean Patent Application No. 10-2011-0048728 filed in the Korean Intellectual Property Office on May 23, 2011, the entire contents of which is incorporated herein for all purposes by this reference.

BACKGROUND OF THE INVENTION

1. Field of the Invention

The present invention relates to a continuously variable valve timing apparatus. More particularly, the present invention relates to an electric continuously variable valve timing apparatus of which entire length may be reduced and engine layout may be simplified.

2. Description of Related Art

Generally, a continuously variable valve timing apparatus (CVVT or Camshaft phaser) is a device which may adjust the timing of the opening and closing of valves.

A general continuously variable valve timing apparatus, usually used in vehicle makers, i.e. a vane-type variable valve timing apparatus, needs relatively small volume and is economical.

The vane-type variable valve timing apparatus, however, uses lubrication oil of an engine, and thus, when oil pressure is low, rapid and accurate control cannot be expected.

Particularly, in idle state, in high temperature, in start condition and so on, when engine oil pressure is not sufficient, relative phase change of a camshaft cannot be obtained, and excessive exhaust gas is generated.

While an electric variable valve timing apparatus may overcome the drawbacks, however for maintaining valve timing which is controlled, power consumption continues and entire length of the apparatus has to be lengthened.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to provide a continuously variable valve timing apparatus having advantages of reducing entire length of the apparatus and varying valve timing without using hydraulic pressure.

An electric continuously variable valve timing apparatus may include a cam sprocket, a camshaft rotatably connected with the cam sprocket, a motor portion, a lead screw portion which is disposed within the motor portion, is screwed-engaged with the motor portion, and moves along length direction of the camshaft according to operations of the motor portion, and a camshaft holder rotatably connecting the lead screw portion and the cam sprocket, wherein the camshaft holder moves along length direction of the camshaft according to the movement of the lead screw portion and varies relative phase angle between the cam sprocket and the camshaft for controlling valve timing.

The motor portion may include a hollow motor shaft which is screwed-engaged with the lead screw portion and moves the lead screw portion along a length direction of the camshaft when the hollow motor shaft operates.

An end portion of the camshaft holder is inserted between the cam sprocket and the camshaft.

The camshaft holder and the camshaft are engaged with each other by a helical spline formed thereto respectively for varying relative phase angle between the camshaft holder and the camshaft when the camshaft holder moves along the length direction of the camshaft.

The camshaft holder and the cam sprocket are engaged with each other by a helical spline formed thereto respectively for varying relative phase angle between the camshaft holder and the cam sprocket when the camshaft holder moves along the length direction of the camshaft.

The camshaft holder and the camshaft are engaged with each other by a first helical spline formed thereto respectively for varying relative phase angle between the camshaft holder and the camshaft when the camshaft holder moves along length direction of the camshaft, and the camshaft holder and the cam sprocket are engaged with each other by a second helical spline formed thereto respectively for varying relative phase angle between the camshaft holder and the cam sprocket when the camshaft holder moves along length direction of the camshaft, wherein the first helical spline and the second helical spline are formed to the same diagonal direction.

A thrust bearing is disposed between the camshaft holder and the lead screw portion.

The camshaft is connected with a camshaft screw portion which is engaged with the camshaft holder, a fixing cam is disposed between the cam sprocket and the camshaft for connecting the camshaft with camshaft screw portion, and the camshaft holder is disposed between the cam sprocket and the camshaft screw portion.

The camshaft holder and the camshaft screw portion are engaged with each other by a helical spline formed thereto respectively for varying relative phase angle between the camshaft holder and the camshaft when the camshaft holder moves along length direction of the camshaft.

The camshaft holder and the cam sprocket are engaged with each other by a helical spline formed thereto respectively for varying relative phase angle between the camshaft holder and the cam sprocket when the camshaft holder moves along length direction of the camshaft.

The camshaft holder and the camshaft screw portion are engaged with each other by a first helical spline formed thereto respectively for varying relative phase angle between the camshaft holder and the camshaft when the camshaft holder moves along length direction of the camshaft, and the camshaft holder and the cam sprocket are engaged with each other by a second helical spline formed thereto respectively for varying relative phase angle between the camshaft holder and the cam sprocket when the camshaft holder moves along the length direction of the camshaft, wherein the first helical spline and the second helical spline are formed to the same diagonal direction.

The camshaft is connected with a camshaft screw portion which is engaged with the camshaft holder, and the camshaft holder is disposed between the cam sprocket and the camshaft screw portion.

An end of the camshaft rotatably encloses an end of the cam sprocket.

The camshaft holder and the camshaft screw portion are engaged with each other by a helical spline formed thereto respectively for varying relative phase angle between the camshaft holder and the camshaft when the camshaft holder moves along length direction of the camshaft.

The camshaft holder and the cam sprocket are engaged with each other by a helical spline formed thereto respectively for varying relative phase angle between the camshaft holder and the cam sprocket when the camshaft holder moves along length direction of the camshaft.

The camshaft holder and the camshaft screw portion are engaged with each other by a first helical spline formed thereto respectively for varying relative phase angle between the camshaft holder and the camshaft when the camshaft holder moves along length direction of the camshaft, and the camshaft holder and the cam sprocket are engaged with each other by a second helical spline formed thereto respectively for varying relative phase angle between the camshaft holder and the cam sprocket when the camshaft holder moves along length direction of the camshaft wherein the first helical spline and the second helical spline are formed to the same diagonal direction.

According to the exemplary embodiments of the present invention, the electric continuously variable valve timing apparatus may vary valve timing regardless oil pressure of an engine.

When adjustment the timing of the opening and closing of valves are not required, the continuously variable valve timing apparatus according to the exemplary embodiment of the present invention doesn't need power supplies and so on so that engine efficiency may be enhanced.

Also, the continuously variable valve timing apparatus according to the exemplary embodiment of the present invention may be manufactured with simple scheme, so that manufacturing cost may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
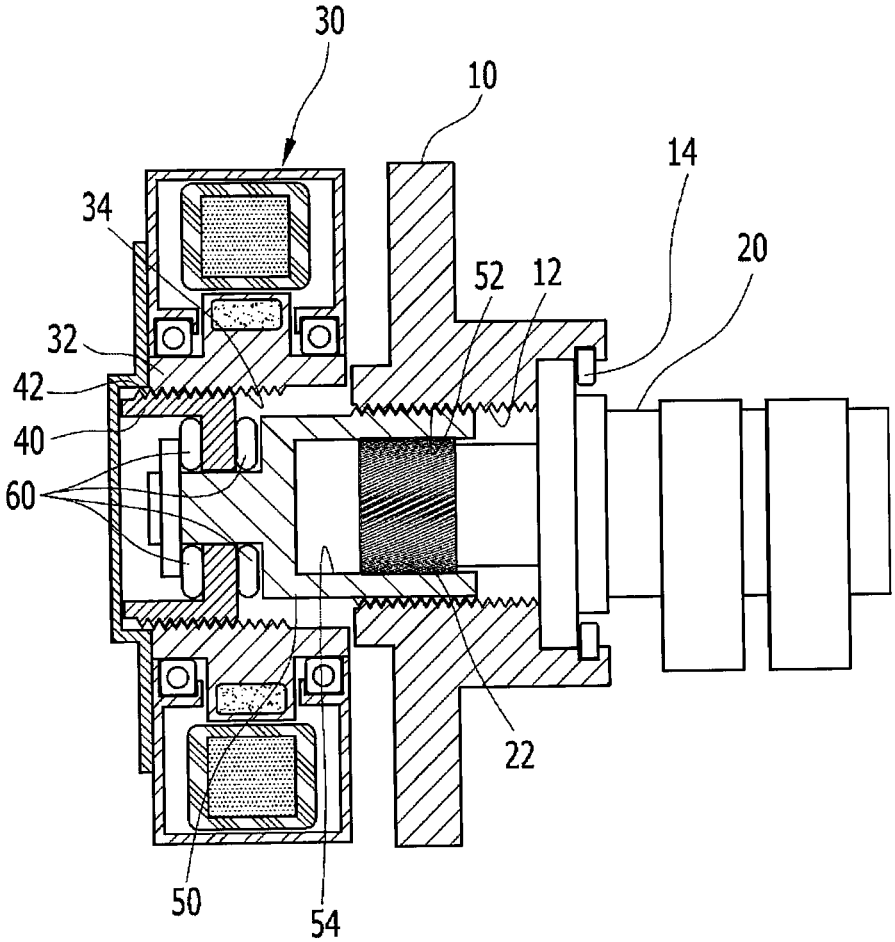
FIG. 1 and FIG. 2 are cross-sectional views of an electric continuously variable valve timing apparatus according to the various exemplary embodiments of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Exemplary embodiments of the present invention will hereinafter be described in detail with reference to the accompanying drawings.

Figure 2:
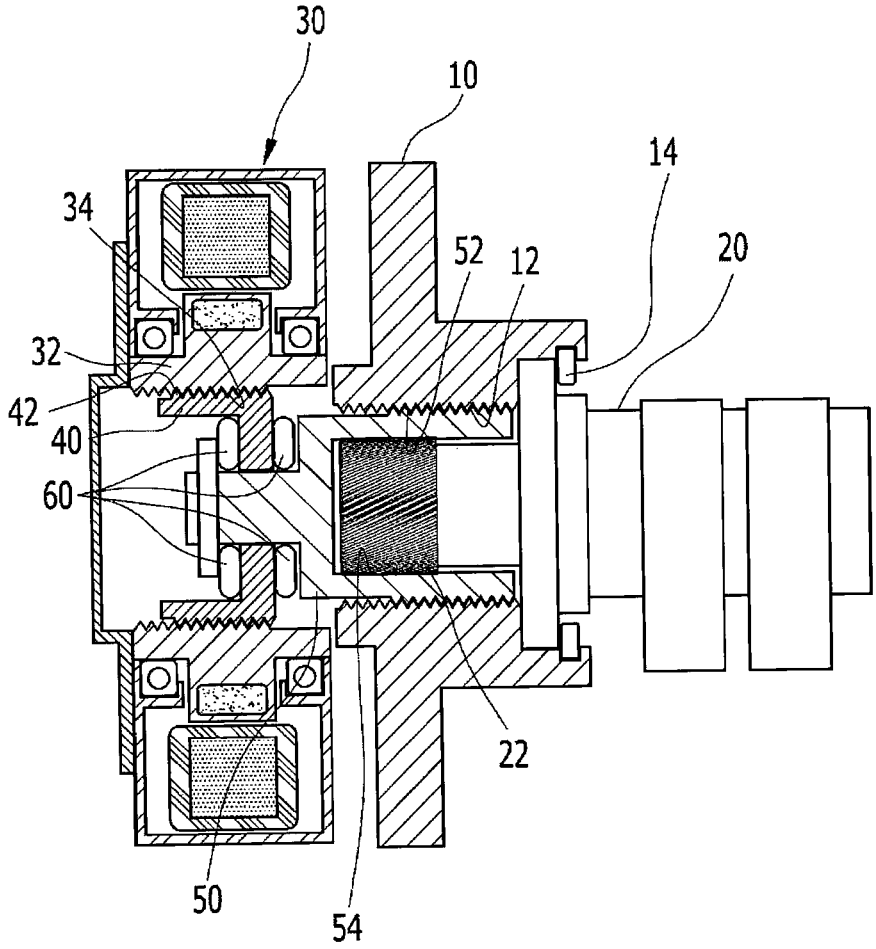
Figure 3:
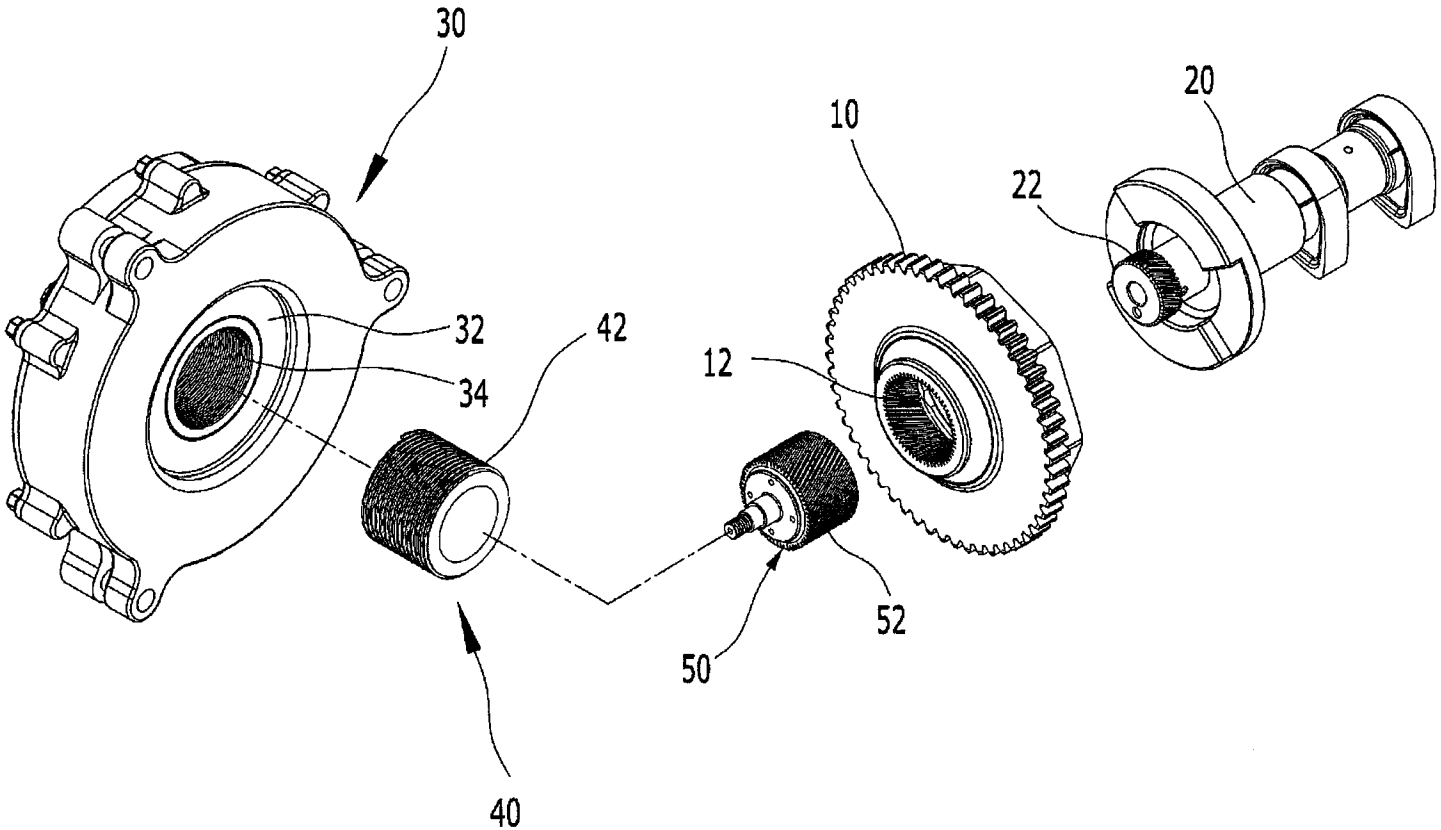
FIG. 3 is a developed view of an electric continuously variable valve timing apparatus according to the various exemplary embodiments of the present invention.

FIG. 1 and FIG. 2 are cross-sectional views of an electric continuously variable valve timing apparatus according to the first exemplary embodiment of the present invention, and FIG. 3 is a developed view of an electric continuously variable valve timing apparatus according to the first exemplary embodiment of the present invention.

Referring to FIG. 1 to FIG. 3, an electric continuously variable valve timing apparatus according to the first exemplary embodiment of the present invention includes a cam sprocket 10, a camshaft 20 rotatably connected with the cam sprocket 10, a motor portion 30, a lead screw portion 40 which is disposed within the motor portion 30, is screwed-engaged with the motor portion 30, and moves along length direction of the camshaft 20 according to operations of the motor portion 30 and a camshaft holder 50 which moves along length direction of the camshaft 20 according to the movement of the lead screw portion 40 and varies relative phase angle between the cam sprocket 10 and the camshaft 20 for controlling valve timing.

A connecting ring 14 is disposed to the cam sprocket 10 and the cam sprocket 10 and the camshaft 20 are assembled by the connecting ring 14.

The motor portion 30 includes a hollow motor shaft 32 which is screwed-engaged with the lead screw portion 40 and moves the lead screw portion 40 along the length direction of the camshaft 20 when the hollow motor shaft 32 operates.

That is, a motor shaft thread 34 is formed to the hollow motor shaft 32 and a lead screw portion thread 42 is formed to the lead screw portion 40, and when the hollow motor shaft 32 rotates, the lead screw portion 40 moves along length direction of the camshaft 20.

The camshaft holder 50 is interposed between the cam sprocket 10 and the camshaft 20.

A thrust bearing 60 is disposed between the camshaft holder 50 and the lead screw portion 40.

The camshaft holder 50 and the camshaft 20 are engaged with each other by a first helical spline formed thereto respectively for varying relative phase angle between the camshaft holder 50 and the camshaft 20 when the camshaft holder 50 moves along length direction of the camshaft 20.

That is, an inner camshaft holder helical spline 54 is formed to the camshaft holder 50, a camshaft helical spline 22 is formed to the camshaft 20 and relative phase angle between the camshaft holder 50 and the camshaft 20 is changed when the camshaft holder 50 moves along length direction of the camshaft 20.

The camshaft holder 50 and the cam sprocket 10 are engaged with each other by a second helical spline formed thereto respectively for varying relative phase angle between the camshaft holder 50 and the cam sprocket 10 when the camshaft holder 50 moves along length direction of the camshaft 20.

That is, an outer camshaft holder helical spline 52 is formed to the camshaft holder 50, a sprocket helical spline 12 is formed to the cam sprocket 10, and relative phase angle between the camshaft holder 50 and the cam sprocket 10 is changed when the camshaft holder 50 moves along length direction of the camshaft 20.

The first helical spline and the second helical spline are formed to the same diagonal direction.

And thus, if the camshaft holder 50 moves along length direction of the camshaft 20, relative phase angel between the camshaft holder 50 and the cam sprocket 10 is changed as "A", and relative phase angel between the camshaft holder 50 and the camshaft 20 is changed as "B", and then relative phase angel between the cam sprocket 10 and the camshaft 20 will be the sum of "A" and "B".

The camshaft holder 50 and the lead screw portion 40 are rotatably connected so that the cam sprocket 10 and the camshaft 20 may be self-locked if adjustment the timing of the opening and closing of valves are not required, so that power supplying to the motor portion 30 does not required and engine efficiency may be enhanced.

Figure 4:
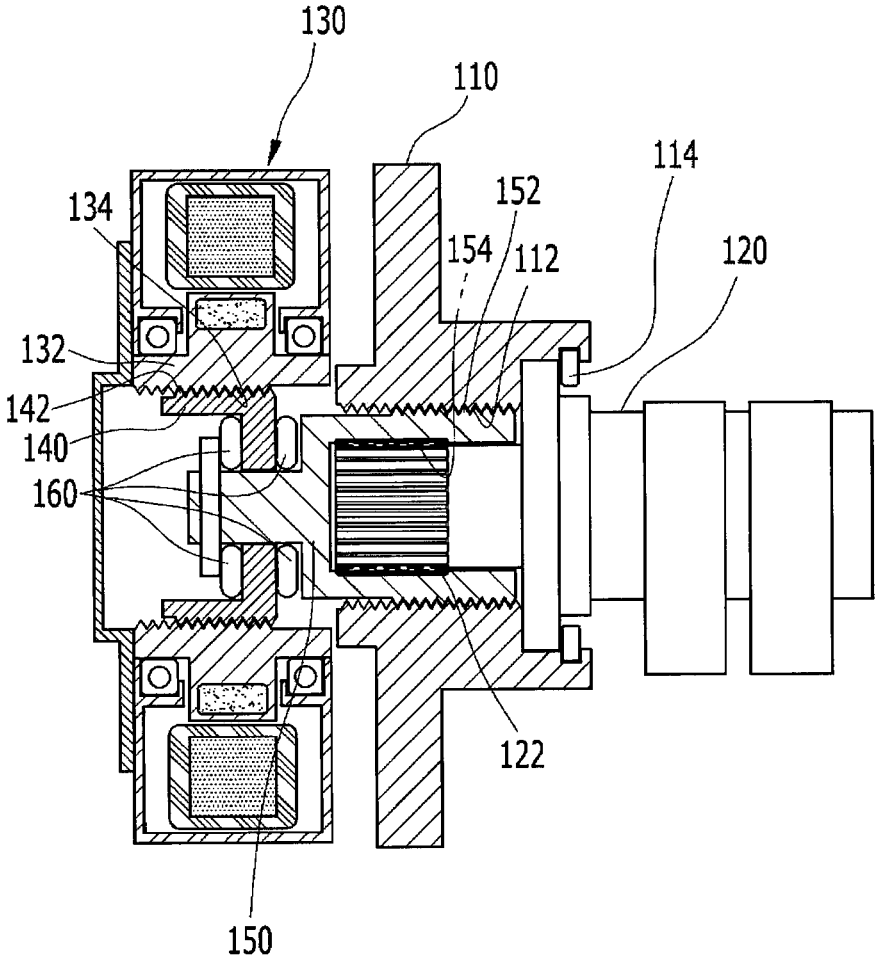
FIG. 4 is a cross-sectional view of an electric continuously variable valve timing apparatus according to the various exemplary embodiments of the present invention.
Figure 5:
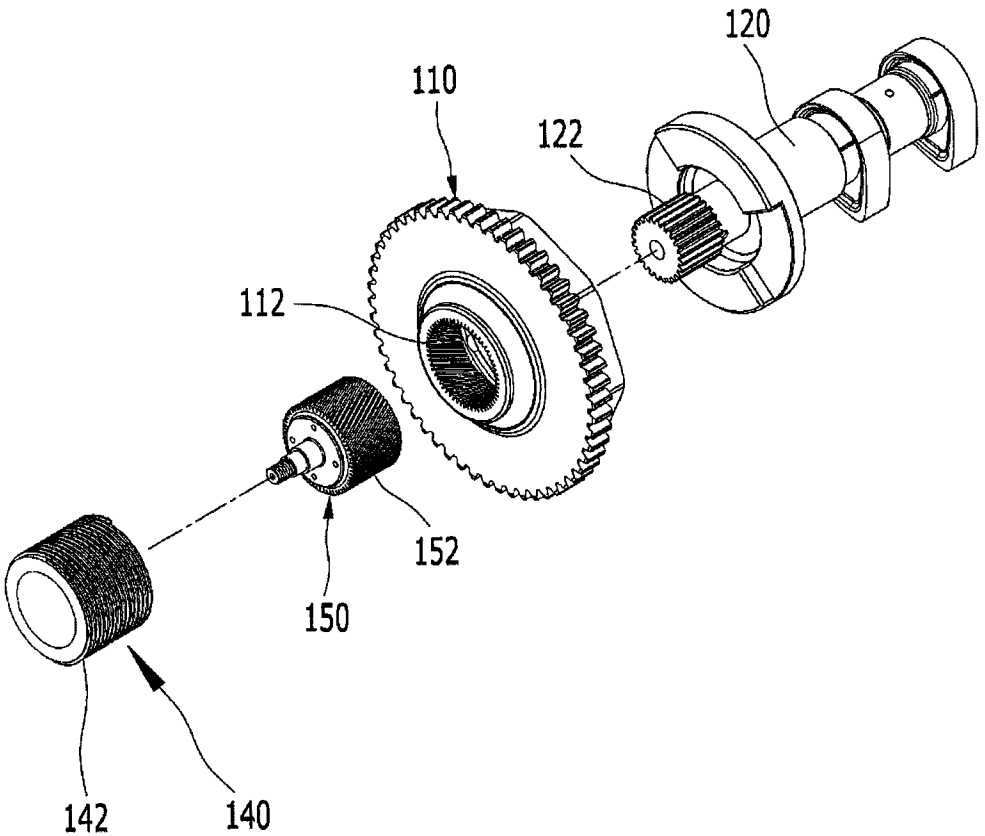
FIG. 5 is a developed view of an electric continuously variable valve timing apparatus according to the various exemplary embodiments of the present invention.

FIG. 4 is a cross-sectional view of an electric continuously variable valve timing apparatus according to the second exemplary embodiment of the present invention, and FIG. 5 is a developed view of an electric continuously variable valve timing apparatus according to the second exemplary embodiment of the present invention.

The second exemplary embodiment of the present invention is similar to the first exemplary embodiment of the present invention so that detailed description of the same elements will be omitted.

Referring to FIG. 4 and FIG. 5, an electric continuously variable valve timing apparatus according to the second exemplary embodiment of the present invention includes a cam sprocket 110, a camshaft 120 rotatably connected with the cam sprocket 110, a motor portion 130, a lead screw portion 140 which is disposed within the motor portion 130, is screwed-engaged with the motor portion 130, and moves along length direction of the camshaft 120 according to operations of the motor portion 130 and a camshaft holder 150 which moves along length direction of the camshaft 120 according to the movement of the lead screw portion 140 and varies relative phase angle between the cam sprocket 110 and the camshaft 120 for controlling valve timing.

A connecting ring 114 is disposed to the cam sprocket 110 and the cam sprocket 10 and the camshaft 120 are assembled by the connecting ring 114.

The motor portion 130 includes a hollow motor shaft 132 which is screwed-engaged with the lead screw portion 140 and moves the lead screw portion 140 along the length direction of the camshaft 120 when the hollow motor shaft 132 operates.

That is, a motor shaft thread 134 is formed to the hollow motor shaft 132 and a lead screw portion thread 142 is formed to the lead screw portion 140, and when the hollow motor shaft 132 rotates, the lead screw portion 140 moves along length direction of the camshaft 120.

A thrust bearing 160 is disposed between the camshaft holder 150 and the lead screw portion 40.

An inner camshaft holder spline 154 is formed to the camshaft holder 150, a camshaft spline 122 is formed to the camshaft 120 and thus relative phase angle between the camshaft holder 150 and the camshaft 120 is not changed while the camshaft holder 150 moves along length direction of the camshaft 120.

An outer camshaft holder helical spline 152 is formed to the camshaft holder 150, a sprocket helical spline 112 is formed to the cam sprocket 110, and relative phase angle between the camshaft holder 150 and the cam sprocket 110 is changed when the camshaft holder 150 moves along length direction of the camshaft 120.

And thus, if the camshaft holder 150 moves along the length direction of the camshaft 20, relative phase angel change between the camshaft holder 150 and the cam sprocket 110 will be the relative phase angel change between the cam sprocket 110 and the camshaft 120.

Comparing with the electric continuously variable valve timing apparatus according to the first exemplary embodiment of the present invention, the electric continuously variable valve timing apparatus according to the second exemplary embodiment of the present invention may reduce forming helical spline process and thus manufacturing process may be simplified while the relative phase change is relatively smaller than that of the first exemplary embodiment.

It is not shown in the drawing, on the contrary, a helical spline may be formed to the camshaft holder 150 and the camshaft 120, and thus relative phase angel change between the camshaft holder 150 and the camshaft 12 will be the relative phase angel change between the cam sprocket 110 and the camshaft 120. Also, in this case, manufacturing process may be simplified while the relative phase change is relatively smaller than that of the first exemplary embodiment.

Figure 6:
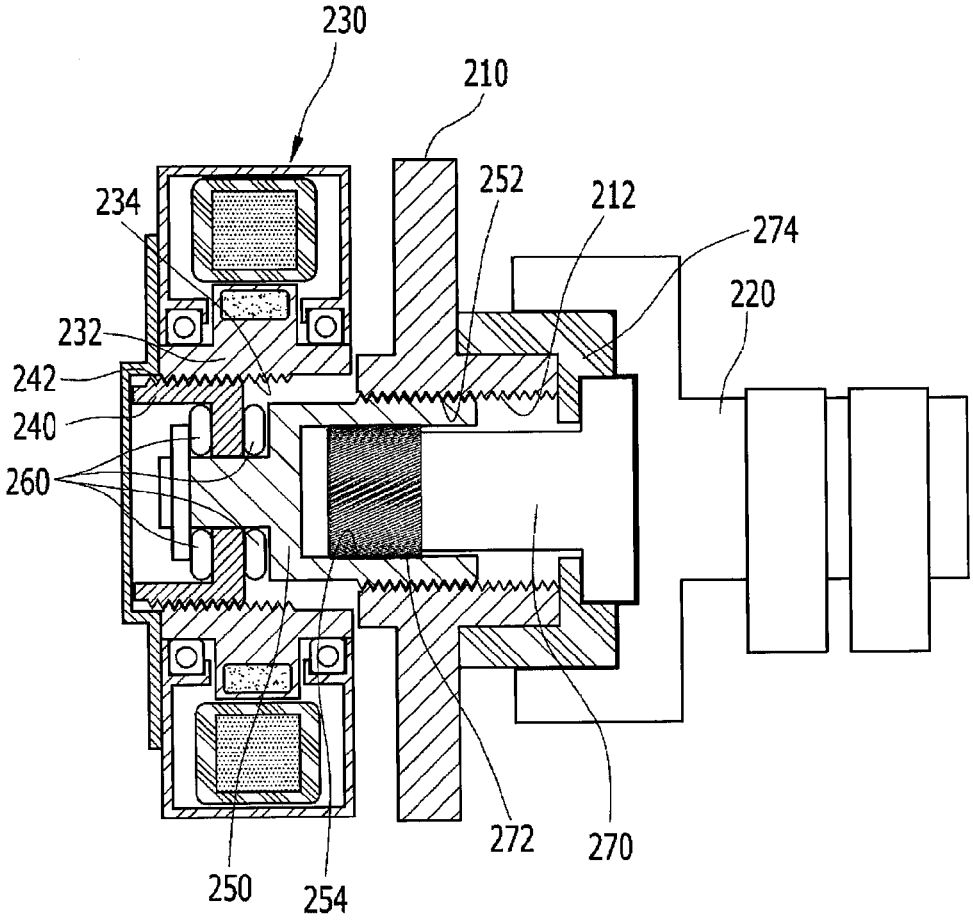
FIG. 6 is a cross-sectional view of an electric continuously variable valve timing apparatus according to the various exemplary embodiments of the present invention.

FIG. 6 is a cross-sectional view of an electric continuously variable valve timing apparatus according to the third exemplary embodiment of the present invention.

The third exemplary embodiment of the present invention is similar to the first exemplary embodiment of the present invention so that detailed description of the same elements will be omitted.

Referring to FIG. 6, an electric continuously variable valve timing apparatus according to the third exemplary embodiment of the present invention includes a cam sprocket 210, a camshaft 220 rotatably connected with the cam sprocket 210, a motor portion 230, a lead screw portion 240 which is disposed within the motor portion 230, is screwed-engaged with the motor portion 320, and moves along length direction of the camshaft 220 according to operations of the motor portion 230 and a camshaft holder 250 which moves along length direction of the camshaft 220 according to the movement of the lead screw portion 240 and varies relative phase angle between the cam sprocket 210 and the camshaft 220 for controlling valve timing.

The motor portion 230 includes a hollow motor shaft 232 which is screwed-engaged with the lead screw portion 240 and moves the lead screw portion 240 along the length direction of the camshaft 220 when the hollow motor shaft 232 operates.

That is, a motor shaft thread 234 is formed to the hollow motor shaft 232 and a lead screw portion thread 242 is formed to the lead screw portion 240, and when the hollow motor shaft 232 rotates, the lead screw portion 240 moves along length direction of the camshaft 220.

A thrust bearing 260 is disposed between the camshaft holder 250 and the lead screw portion 240.

The camshaft 220 is connected to a camshaft screw portion 270 which is engaged with the camshaft holder 250, and a fixing cam 274 is disposed between the cam sprocket 210 and the camshaft 220 for assembling the camshaft 220 and the camshaft screw portion 270. The camshaft screw portion 270 and the camshaft 220 are assembled by the fixing cam 274 as screw connection, forcible inserting, welding and so on, and thus assembling process may be enhanced.

The camshaft holder 250 is inserted between the cam sprocket 210 and the camshaft screw portion 270.

The camshaft holder 250 and the camshaft screw portion 270 are engaged with each other by a helical spline formed thereto respectively for varying relative phase angle between the camshaft holder 250 and the camshaft 270 when the camshaft holder 250 moves along length direction of the camshaft 220.

An inner camshaft holder helical spline 254 is formed to the camshaft holder 250, a camshaft helical spline 272 is formed to the camshaft screw portion 270 and thus relative phase angle between the camshaft holder 250 and the camshaft 220 is changed while the camshaft holder 250 moves along length direction of the camshaft 220.

An outer camshaft holder helical spline 252 is formed to the camshaft holder 250, a sprocket helical spline 212 is formed to the cam sprocket 210, and relative phase angle between the camshaft holder 250 and the cam sprocket 210 is changed when the camshaft holder 250 moves along length direction of the camshaft 220.

Similar to the second exemplary embodiment of the present invention, spline engagement, of which relative phase angle change does not occur, between the camshaft holder 250 and the camshaft screw portion 270, or the camshaft holder 250 between the cam sprocket 210 may also possible.

In the third exemplary embodiment of the present invention, since the camshaft screw portion 270 may be assembled to the camshaft 220 using the fixing cam 274, and thus assemble process may be enhanced and simplified.

Figure 7:
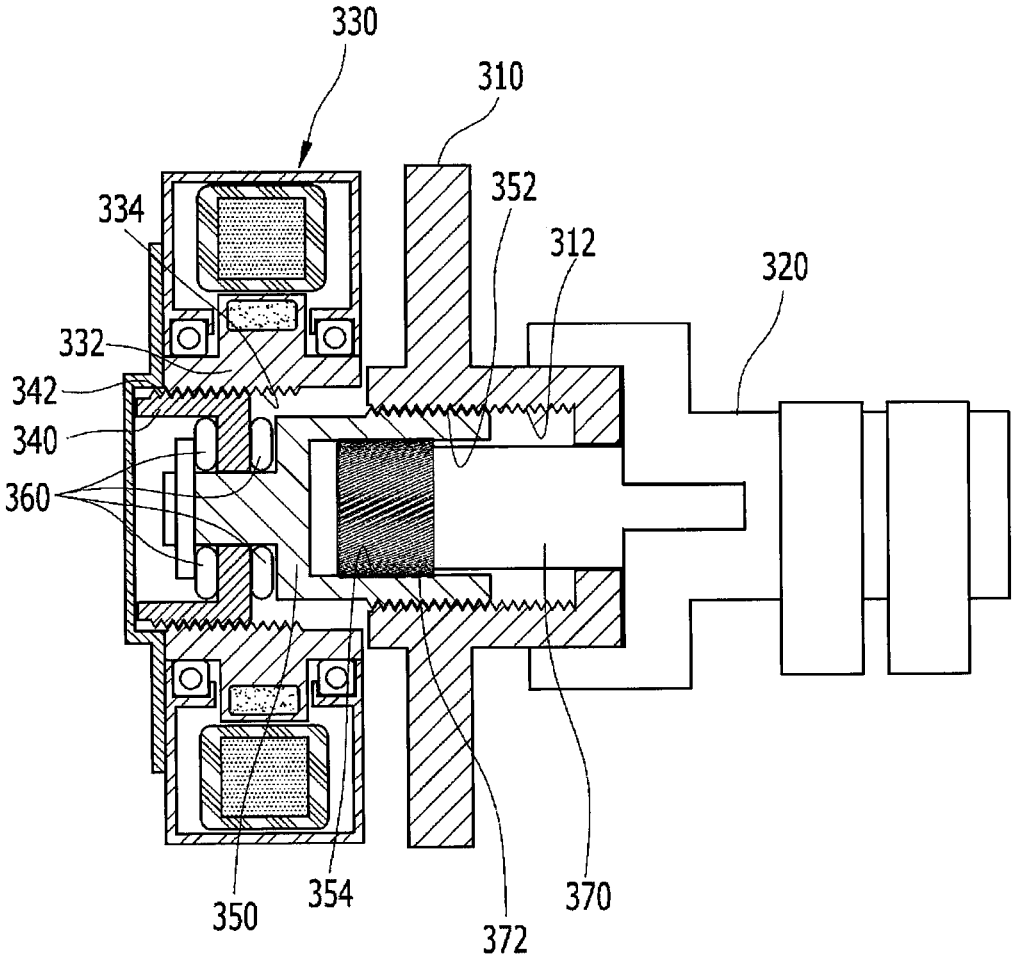
FIG. 7 is a cross-sectional view of an electric continuously variable valve timing apparatus according to the various exemplary embodiments of the present invention.

FIG. 7 is a cross-sectional view of an electric continuously variable valve timing apparatus according to the fourth exemplary embodiment of the present invention.

The fourth exemplary embodiment of the present invention is similar to the first exemplary embodiment of the present invention so that detailed description of the same elements will be omitted.

Referring to FIG. 7, an electric continuously variable valve timing apparatus according to the fourth exemplary embodiment of the present invention includes a cam sprocket 310, a camshaft 320 rotatably connected with the cam sprocket 310, a motor portion 330, a lead screw portion 340 which is disposed within the motor portion 330, is screwed-engaged with the motor portion 330, and moves along length direction of the camshaft 320 according to operations of the motor portion 330 and a camshaft holder 350 which moves along length direction of the camshaft 320 according to the movement of the lead screw portion 340 and varies relative phase angle between the cam sprocket 310 and the camshaft 320 for controlling valve timing.

The motor portion 330 includes a hollow motor shaft 332 which is screwed-engaged with the lead screw portion 340 and moves the lead screw portion 340 along the length direction of the camshaft 320 when the hollow motor shaft 332 operates.

That is, a motor shaft thread 334 is formed to the hollow motor shaft 332 and a lead screw portion thread 342 is formed to the lead screw portion 340, and when the hollow motor shaft 332 rotates, the lead screw portion 340 moves along length direction of the camshaft 320.

A thrust bearing 360 is disposed between the camshaft holder 350 and the lead screw portion 340.

The camshaft 320 is connected to a camshaft screw portion 370 which is engaged with the camshaft holder 350, and the camshaft holder 350 is inserted between the cam sprocket 310 and the camshaft screw portion 370.

The camshaft holder 350 and the camshaft screw portion 370 are engaged with each other by a helical spline formed thereto respectively for varying relative phase angle between the camshaft holder 350 and the camshaft 370 when the camshaft holder 350 moves along length direction of the camshaft 320.

An inner camshaft holder helical spline 354 is formed to the camshaft holder 350, a camshaft helical spline 372 is formed to the camshaft screw portion 370 and thus relative phase angle between the camshaft holder 350 and the camshaft 320 is changed while the camshaft holder 350 moves along length direction of the camshaft 320.

An outer camshaft holder helical spline 352 is formed to the camshaft holder 230, a sprocket helical spline 312 is formed to the cam sprocket 310, and relative phase angle between the camshaft holder 350 and the cam sprocket 310 is changed when the camshaft holder 350 moves along length direction of the camshaft 320.

Similar to the second exemplary embodiment of the present invention, spline engagement, of which relative phase angle change does not occur, between the camshaft holder 350 and the camshaft screw portion 370, or the camshaft holder 350 between the cam sprocket 310 may also possible.

In the fourth exemplary embodiment of the present invention, since the camshaft screw portion 370 may be assemble to the camshaft 320 and thus assemble process may be enhanced and simplified.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An electric continuously variable valve timing apparatus comprising:

a cam sprocket;

a camshaft rotatably connected with the cam sprocket;

a motor portion;

a lead screw portion which is disposed within the motor portion, is screwed-engaged with the motor portion, and moves along a length direction of the camshaft according to operations of the motor portion; and a camshaft holder rotatably connecting the lead screw portion and the cam sprocket, wherein the camshaft holder moves along a length direction of the camshaft according to the movement of the lead screw portion and varies relative phase angle between the cam sprocket and the camshaft for controlling valve timing;

wherein the motor portion includes a hollow motor shaft which is screwed-engaged with the lead screw portion and moves the lead screw portion along the length direction of the camshaft when the hollow motor shaft operates;

wherein an end portion of the camshaft holder is inserted between the cam sprocket and the camshaft.

2. The electric continuously variable valve timing apparatus of claim 1, wherein the camshaft holder and the camshaft are engaged with each other by a helical spline formed thereto respectively for varying relative phase angle between the camshaft holder and the camshaft when the camshaft holder moves along the length direction of the camshaft.

3. The electric continuously variable valve timing apparatus of claim 1, wherein the camshaft holder and the cam sprocket are engaged with each other by a helical spline formed thereto respectively for varying relative phase angle between the camshaft holder and the cam sprocket when the camshaft holder moves along the length direction of the camshaft.

4. The electric continuously variable valve timing apparatus of claim 1, wherein:

the camshaft holder and the camshaft are engaged with each other by a first helical spline formed thereto respectively for varying relative phase angle between the camshaft holder and the camshaft when the camshaft holder moves along length direction of the camshaft; and the camshaft holder and the cam sprocket are engaged with each other by a second helical spline formed thereto respectively for varying relative phase angle between the camshaft holder and the cam sprocket when the camshaft holder moves along length direction of the camshaft;

wherein the first helical spline and the second helical spline are formed to the same diagonal direction.

5. The electric continuously variable valve timing apparatus of claim 1, wherein:

the camshaft is connected with a camshaft screw portion which is engaged with the camshaft holder; and the camshaft holder is disposed between the cam sprocket and the camshaft screw portion.

6. The electric continuously variable valve timing apparatus of claim 5, wherein the camshaft holder and the camshaft screw portion are engaged with each other by a helical spline formed thereto respectively for varying relative phase angle between the camshaft holder and the camshaft when the camshaft holder moves along length direction of the camshaft.

7. An electric continuously variable valve timing apparatus comprising:

a cam sprocket;

a camshaft rotatably connected with the cam sprocket;

a motor portion;

a lead screw portion which is disposed within the motor portion, is screwed-engaged with the motor portion, and moves along a length direction of the camshaft according to operations of the motor portion; and a camshaft holder rotatably connecting the lead screw portion and the cam sprocket, wherein the camshaft holder moves along a length direction of the camshaft according to the movement of the lead screw portion and varies relative phase angle between the cam sprocket and the camshaft for controlling valve timing;

wherein the motor portion includes a hollow motor shaft which is screwed-engaged with the lead screw portion and moves the lead screw portion along the length direction of the camshaft when the hollow motor shaft operates;

wherein a thrust bearing is disposed between the camshaft holder and the lead screw portion.

8. An electric continuously variable valve timing apparatus comprising:

a cam sprocket;

a camshaft rotatably connected with the cam sprocket;

a motor portion;

a lead screw portion which is disposed within the motor portion, is screwed-engaged with the motor portion, and moves along a length direction of the camshaft according to operations of the motor portion; and a camshaft holder rotatably connecting the lead screw portion and the cam sprocket, wherein the camshaft holder moves along a length direction of the camshaft according to the movement of the lead screw portion and varies relative phase angle between the cam sprocket and the camshaft for controlling valve timing;

wherein the motor portion includes a hollow motor shaft which is screwed-engaged with the lead screw portion and moves the lead screw portion along the length direction of the camshaft when the hollow motor shaft operates;

the camshaft is connected with a camshaft screw portion which is engaged with the camshaft holder; and the camshaft holder is disposed between the cam sprocket and the camshaft screw portion;

wherein an end of the camshaft rotatably encloses an end of the cam sprocket.

9. An electric continuously variable valve timing apparatus comprising:

a cam sprocket;

a camshaft rotatably connected with the cam sprocket;

a motor portion;

a lead screw portion which is disposed within the motor portion, is screwed-engaged with the motor portion, and moves along a length direction of the camshaft according to operations of the motor portion; and a camshaft holder rotatably connecting the lead screw portion and the cam sprocket, wherein the camshaft holder moves along a length direction of the camshaft according to the movement of the lead screw portion and varies relative phase angle between the cam sprocket and the camshaft for controlling valve timing;

wherein the motor portion includes a hollow motor shaft which is screwed-engaged with the lead screw portion and moves the lead screw portion along the length direction of the camshaft when the hollow motor shaft operates;

the camshaft is connected with a camshaft screw portion which is engaged with the camshaft holder; and the camshaft holder is disposed between the cam sprocket and the camshaft screw portion;

wherein the camshaft holder and the cam sprocket are engaged with each other by a helical spline formed thereto respectively for varying relative phase angle between the camshaft holder and the cam sprocket when the camshaft holder moves along length direction of the camshaft.

10. An electric continuously variable valve timing apparatus comprising:

a cam sprocket;

a camshaft rotatably connected with the cam sprocket;

a motor portion;

a lead screw portion which is disposed within the motor portion, is screwed-engaged with the motor portion, and moves along a length direction of the camshaft according to operations of the motor portion; and a camshaft holder rotatably connecting the lead screw portion and the cam sprocket, wherein the camshaft holder moves along a length direction of the camshaft according to the movement of the lead screw portion and varies relative phase angle between the cam sprocket and the camshaft for controlling valve timing;

wherein the motor portion includes a hollow motor shaft which is screwed-engaged with the lead screw portion and moves the lead screw portion along the length direction of the camshaft when the hollow motor shaft operates;

the camshaft is connected with a camshaft screw portion which is engaged with the camshaft holder; and the camshaft holder is disposed between the cam sprocket and the camshaft screw portion wherein the camshaft holder and the camshaft screw portion are engaged with each other by a first helical spline formed thereto respectively for varying relative phase angle between the camshaft holder and the camshaft when the camshaft holder moves along length direction of the camshaft; and wherein the camshaft holder and the cam sprocket are engaged with each other by a second helical spline formed thereto respectively for varying relative phase angle between the camshaft holder and the cam sprocket when the camshaft holder moves along length direction of the camshaft;

wherein the first helical spline and the second helical spline are formed to the same diagonal direction.

* * * * *